United States Patent [19]

Suzuki

[11] Patent Number: 4,573,389

[45] Date of Patent: Mar. 4, 1986

[54] MUSICAL TONE GENERATION DEVICE OF WAVESHAPE MEMORY TYPE

[75] Inventor: Norio Suzuki, Hamamatsu, Japan

[73] Assignee: Nippon Gakki Seizo Kabushiki Kaisha, Hamamatsu, Japan

[21] Appl. No.: 584,552

[22] Filed: Feb. 29, 1984

[30] Foreign Application Priority Data

Mar. 4, 1983 [JP] Japan ..... 58-36198

[51] Int. Cl.[4] ..... G10H 1/02; G10H 7/00

[52] U.S. Cl. ..... 84/1.26; 84/1.13

[58] Field of Search ..... 84/1.13, 1.26

[56] References Cited

U.S. PATENT DOCUMENTS 4,194,426 3/1980 Deutsch et al. ..... 84/1.26 X
4,442,745 4/1984 Gross et al. ..... 84/1.26 X
4,502,361 3/1985 Viitanen et al. ..... 84/1.26
4,524,666 6/1985 Kato ..... 84/1.26 X

*Primary Examiner*—S. J. Witkowski
*Attorney, Agent, or Firm*—Spensley, Horn, Jubas & Lubitz

[57] ABSTRACT

A musical tone generation device of waveshape memory type stores, in its memory, waveshape data of an entire part of a rising portion of a musical tone waveshape and waveshape data of only a part of a remainder portion succeeding to the rising portion. The rising portion data is read out once while the remainder portion data is repetitively read out from the memory thereby to reproduce the entire musical tone waveshape. By changing a rate for the repetitive readout operation, a pitch of the musical tone waveshape at the portion succeeding to the rising portion can be changed with passage of time.

6 Claims, 5 Drawing Figures

FIG. 4
FIG. 4 (a)
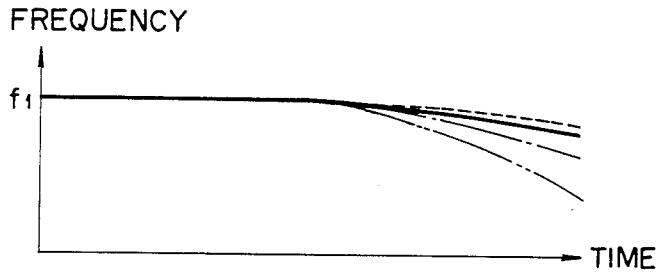
FIG. 4 (b)
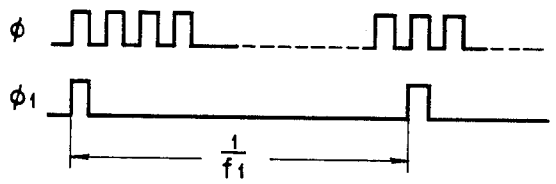

MUSICAL TONE GENERATION DEVICE OF WAVESHAPE MEMORY TYPE

FIELD OF THE INVENTION

The present invention relates to a musical tone generation device used in an electronic musical instrument or the like and, more particularly, to a musical tone generation device which produces a musical tone by reading out data about the waveform of the tone which has previously been stored in a waveshape memory.

BACKGROUND OF THE INVENTION

Some electronic musical instruments produce musical tones by reading the data about waveshapes of musical tones from a waveshape memory. In a known instrument of this type, as exemplified in U.S. Pat. No. 4,383,462 issued on May 17, 1983 and assigned to the same assignee as the present application, the data about the whole waveshape of a musical tone beginning with its attack portion and ending with its decay portion is previously stored in a waveshape memory, and when the musical tone is to be produced, the data is read from the memory. This prior art instrument is able to produce musical tones closely resembling those of acoustic, non-electronic musical instruments, and it is especially adapted to obtain percussive sounds, as produced by percussions, whose timbres and pitches change with time. Unfortunately, it requires an exorbitantly large capacity of memory to store data about waveforms.

SUMMARY OF THE INVENTION

It is an object of the present invention to provide a musical tone generation device which needs a less capacity of memory to store the data about the waveforms of a musical tone and which is capable of producing sounds resembling those of acoustic, non-electronic musical instruments more closely than conventional.

In summary, the musical tone generation device according to the present invention stores in its waveshape memory all the data of a musical tone waveshape at the rising portion, or attack portion, where the waveshape varies in a complex manner, and it stores in the memory the data about only part (e.g. 1 or 2 cycles) of the portion following the rising portion where the waveshape varies in a less complex manner. After the data about the rising portion of the waveform is read once from the memory, the data about the aforementioned part of the succeeding portion is repeatedly read to produce the intended musical tone.

In general, sounds produced by a percussion such as tom-tom undergo a change in pitch while such sounds are being generated. Therefore, there is a tendency that the pitch is higher at the rising portion of such a sound and then it becomes gradually lower.

In view of the foregoing phenomenon, the device according to the invention can change with time the rate at which the above-described part of the suceeding portion of the waveshape is repeatedly read to produce a sound whose pitch varies with time during the production of the sound.

Other objects and features of the invention will appear in the course of the description thereof which follows.

BRIEF DESCRIPTION OF THE DRAWINGS

FIGS 4 (*a*) and (*b*) are waveform charts for illustrating the operation of the circuit shown in FIG. 3.

DETAILED DESCRIPTION OF THE PREFERRED EMBODIMENT

Figure 1:
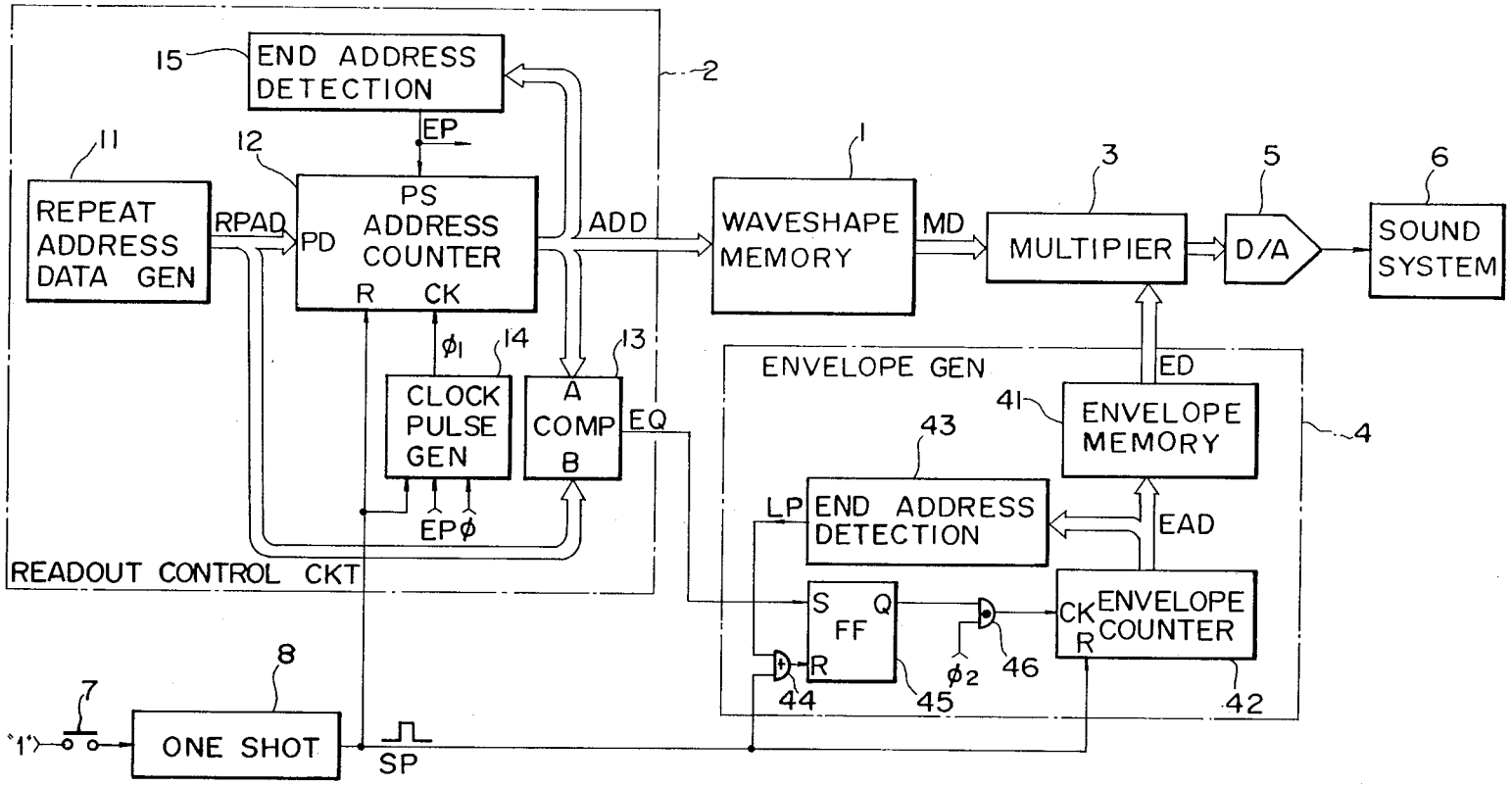
FIG. 1 is a block diagram of an example of a musical tone generation device according to the present invention.
Figure 2:
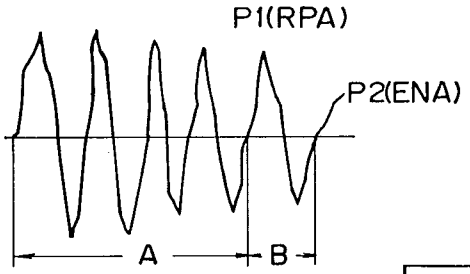
FIG. 2 is a waveform chart of a musical tone the data about which is stored in the waveshape memory of the device shown in FIG. 1.

Referring first to FIG. 1, there is shown a musical tone generation device embodying the concept of the present invention. This device includes a waveshape memory 1 consisting of a read-only memory, abbreviated ROM, for example. The data about the whole rising portion of the waveshape of a sound and the data about part (e.g. 1 or 2 cycles) of the portion following the rising portion have been previously stored in the memory 1, corresponding to the sound produced by an acoustic, non-electronic musical instrument which should be imitated. More specifically, as shown in FIG. 2, the digital data items indicating the amplitude values at the rising portion A of the waveshape of the sound which were taken at sampled discrete instants over a plurality of periods and the digital data items which were taken similarly about the portion B following the rising portion A over one period have been stored at respective addresses in the memory 1 consecutively from address 0. The address of the memory 1 at which the first instantaneous value of amplitude at the portion B (point P1 in FIG. 2) is stored is hereinafter referred to as the repeat address (RPA), while the address of the memory 1 at which the last instantaneous value at the portion B (point P2) is stored is hereinafter referred to as the end address (ENA).

The digital data items MD which indicate the instantaneous amplitude values of the waveshape of the musical tone and have been stored in the respective addresses of the memory 1 in this way are successively read and supplied to a multiplier circuit 3, according to an address data (ADD) which is delivered from a read-out control circuit 2. In this case, the data items MD about the rising portion A of the waveshape are first read out successively. Then, the data items MD about the portion B are successively and repeatedly read out.

In the multiplier circuit 3, the data MD about the waveshape delivered from the memory 1 is multiplied by the envelope data ED produced by an envelope generator 4. The results of the multiplication are fed to a digital-to-analog converter 5. The envelope generator 4 produces a signal of state "1" in decimal notation while the waveshape data MD for the rising portion A is being read from the memory 1. When the waveshape data MD for the portion B is being repeatedly read from the memory 1, the generator 4 delivers the envelope data ED that decreases gradually as "0.9", "0.85", ..., "0". That is, an amplitude envelope is given to the portion of the sound signal following the rising portion by the combination of the envelope generator 4 and the multiplier circuit 3. The A/D converter 5 changes the output data from the multiplier 3 into analog form, which is then supplied to a sound system 6 to generate a musical tone.

The aforementioned readout control circuit 2 is now described in detail. This circuit 2 includes a repeat address data generator circuit 11 which is made up of digital switches, a ROM, or other means. The circuit 11 delivers repeat address data (RPAD) indicating the aforementioned repeat address RPA (see FIG. 2) to the preset data terminal PD of an address counter 12 and also to the input terminal B of a comparator circuit 13. The counter 12 is an up counter whose contents increase as a clock-pulse generator circuit 14 supplies clock pulses $\phi 1$ to the clock terminal CK of the counter. When a pulse signal of state "1" is furnished to the preset control terminal PS of the counter 12, this counter is preset to the repeat address data RPAD which is applied to the preset data terminal PD. When a pulse signal of state "1" is provided to the reset terminal R, the counter is reset. The total count obtained by the counter 12 is supplied as address data ADD to the waveshape memory 1 and also to the input terminal terminal A of the comparator circuit 13 and to an end address detection circuit 15. When the contents of the address data ADD equal the aforementioned end address ENA (FIG. 2), this condition is detected by the detection circuit 15, which then produces an end pulse EP of state 1 to the preset control terminal PS of the address counter 12. The comparator circuit 13 compares the address data ADD given to its input terminal A with the repeat address data RPAD supplied to its input terminal B, and when the coincidence is attained, i.e., the contents of the address data ADD reach the repeat address RPA, a signal EQ of state "1" indicating the coincidence is delivered to the envelope generator 4. The reset terminal R of the counter 12 is supplied with a start pulse SP which is produced by a one-shot multivibrator 8 in response to the leading edge of the output signal from a sound production command switch 7, the pulse SP having a given pulse duration.

In the readout control circuit 2 constructed as described above, when the command switch 7 is closed, the one-shot multivibrator 8 delivers the start pulse SP of state "1" to reset the address counter 12. Thereafter, the counter 12 counts the clock pulses $\phi 1$ produced from the clock pulse generator circuit 14 one by one. The output from the counter 12, i.e., the address data ADD, increases from zero in one increments and is fed to the waveshape memory 1. Then, the data items MD about the rising portion A of the waveform of the musical tone are successively read out. Subsequently, the data items MD about the portion B of the waveform are successively read out. When the contents of the address data ADD delivered from the counter 12 become equal to the end address ENA, the end address detection circuit 15 delivers end pulse EP of state 1 to the preset control terminal PS of the counter 12. This presets the counter 12 to the repeat address data RPAD. Thereafter, the counter 12 restarts to count the clock pulses $\phi 1$ from the data RPAD. Consequently, after reaching the end address ENA, the address data ADD delivered from the counter 12 returns to the repeat address RPA, and then it changes one by one toward the end address ENA. Therefore, the data items MD about the portions of the waveshape ranging from the repeat address RPA to the end address ENA are read from the memory 1 again. When the address data ADD arrives at the end address ENA, the end address detection circuit 15 delivers the end pulse EP, presetting the counter 12 to the repeat address data RPAD. These operations are repeated afterward. In this way, when the sound production command switch 7 is closed, the data items MD about the rising portion A of the waveshape of the musical tone are first read from the waveshape memory 1. Subsequently, the data items MD about the succeeding portion B are repeatedly read out, whereby the musical tone is created. The envelope generator 4 is now described in detail. This generator includes an envelope memory 41 that is a ROM for storing envelope data items ED in it from address 0 consecutively, the data items ED decreasing as "1", "0.9", "0.85",..., "0", for example. These envelope data items ED are successively read from the addresses, according to the address data EAD delivered from an envelope counter 42, and they are furnished to the multiplier circuit 3. When an end address detection circuit 43 senses the correspondence of the address data items EAD from the counter 42 with the final address of the memory 41, it delivers a detection signal LP of state "1".

When the sound production switch 7 is closed, the start pulse SP of state "1" is produced from the one-shot multivibrator 8. This start pulse SP is supplied to the reset terminal R of the envelope counter 42, and it is also fed via an OR circuit 44 to the reset circuit R of a flip-flop 45. This resets the envelope counter 42, causing the output from the counter to assume state "0". At the same time, the flip-flop 45 is also reset, so that the output signal Q from this flip-flop takes up state "0". The output signal Q from the flip-flop 45 is fed to an AND circuit 46 which is supplied with clock pulses $\phi 2$ whose frequency is sufficiently lower than that of the clock pulses $\phi 1$. In this case, since the output signal is in state "0", the AND circuit 46 is disenabled to prevent the clock pulses $\phi 2$ from being applied to the clock terminal CK of the envelope counter 42. Therefore, the counter 42 is maintained in its reset state, and the output of state 0 is supplied as the address data EAD to the envelope memory 41. This causes the envelope data ED in state "1" to be read from address 0 of the memory 41 for application to the multiplier circuit 3. This condition is maintained until the comparator circuit 13 in the readout control circuit 2 delivers a coincidence signal EQ to set the flip-flop 45. During this process, the data items MD about the rising portion A of the waveform of the musical tone are successively read from the waveshape memory 1, as described above. In the control circuit 2, when the address data ADD delivered from the address counter 12 reaches the repeat address RPA, the comparator 13 produces the coincidence signal EQ of state "1" as mentioned previously. This signal EQ is furnished to the set terminal S of the flip-flop 45, thus setting it. Then, the output signal Q from the flip-flop which is now caused to assume state "1" enables the AND circuit 46. This allows the clock pulses $\phi 2$ to be passed through the AND circuit 46, and the pulses are then fed to the clock terminal CK of the envelope counter 42, which then counts the pulses $\phi 2$ so that its contents increase. As a result, the address data EAD changes consecutively as "1", "2", .... Hence, the data items ED, that is "0.9", "0.85", ..., about the envelope which are stored in the addresses "1", "2", etc. are successively read out and supplied to the multiplier circuit 3, so that the amplitude of the produced music tone decays gradually. When the total count obtained by the counter 42 reaches such a value that the address data EAD indicates the final address, the envelope data ED of state 0 stored in the final address of the memory 41 is read out and fed to the multiplier circuit 3. This causes the output data from the multiplier circuit 3 to assume state 0, thereby stopping the production of the musical tone. Also, when the address data EAD reaches the final address, this condition is sensed by the end address detection circuit 43, which then delivers the detection signal LP of state 1. This signal LP is given via the OR circuit 44 to the reset terminal R of the flip-flop 45 to reset the flip-flop 45 and so the output signal Q assumes state "0". This disenables the AND circuit 46 to prevent the clock pulses $\phi 2$ from being supplied to the counter 42. Thus, the count operation of the counter 42 stops, and the address data EAD specifying the final address is continuously delivered. As such, the condition in which the production of the musical tone is stopped is maintained afterward. If the switch 7 is closed again, then the musical tone will be produced again.

In this case, the production of the musical tone is halted by causing the envelope data ED of state "1" to be read from the envelope memory 41, as noted above, but the readout from the waveshape memory 1 is continued afterward. This will not present major problems, but preferably the readout operation is stopped when the production of the musical tone ceases. This can be achieved by making the waveshape memory 1 or the address counter 12 inoperative (e.g. the counter 12 is reset) according to the detection signal LP delivered from the final address detection circuit 43.

In this illustrative example, when the data items MD about the portion B of the waveform of the musical tone are repeatedly read from the waveshape memory 1, the rate at which the data items are read out, that is, the frequency of the clock pulses $\phi 1$, is altered in order to vary the pitch while the tone is being produced. This is described next in greater detail.

Figure 3:
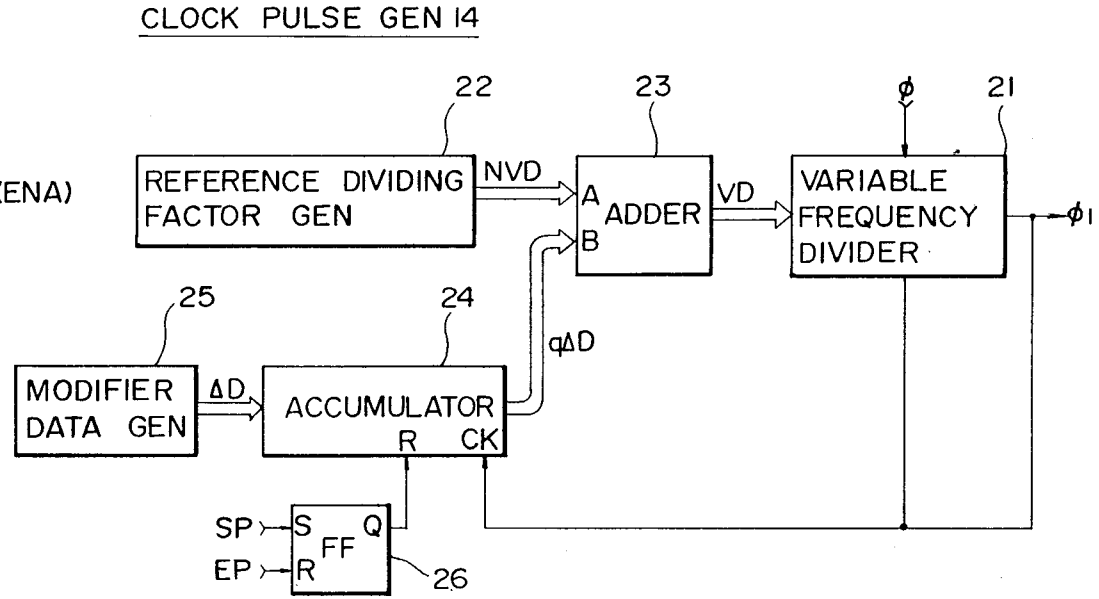
FIG. 3 is a block diagram of a specific example of the clock pulse generator circuit incorporated in the device shown in FIG. 1.

The clock pulse generator circuit 14 delivers the clock pulses $\phi 1$ whose frequency varies as shown in FIG. 4 (*a*). An example of specific structure of the circuit 14 is shown in FIG. 3, where the pulse generator circuit 14 includes a variable frequency divider 21 that acts to produce clock pulses $\phi 1$ whose frequency is an integral submultiple of the frequency of incoming master clock pulses $\phi$. The divider 21 is so controlled that the dividing factor in the frequency division becomes larger gradually with time to lower the frequency of the clock pulses $\phi 1$ gradually as shown in FIG. 4 (*a*).

Referring also to FIG. 3, a reference dividing factor generator circuit 22 produces a data NVD indicating the reference dividing factor that determines the initial frequency of the pulses $\phi 1$. The produced reference dividing factor data NVD is fed to the input terminal A of an adder circuit 23, the input terminal B of which is supplied with the output data $q\Delta D$ from an accumulator 24. The adder 23 functions to combine the data NVD and $q\Delta D$ and to deliver the sum (NVD $+q\Delta D$) to the frequency divider 21 as a frequency division data VD. Thus, the frequency divider 21 produces clock pulse $\phi 1$ whose frequency is an integer submultiple of the frequency of the master clock pulses $\phi$, the submultiple being varied according to the frequency division data VD. A modifier data generator circuit 25 serves to deliver a data $\Delta V$ about a modified dividing factor that determines the increment in the dividing factor, which in turn determines the increment in the frequency of the clock pulses $\phi 1$. The produced data $\Delta D$ about the modified dividing factor is supplied to the accumulator 24. This data $\Delta D$ is set to a very small value less than unity, say 0.1, in order to change the frequency of the clock pulses $\phi 1$ very slowly. The accumulator 24 has a clock terminal CK to which the clock pulses $\phi 1$ are supplied from the variable frequency divider 21. The accumulator 24 adds the data $\Delta D$ about the modified dividing factor to the number already stored each time each clock pulse $\phi 1$ arrives at it, and the device 24 gives only the integral portion of the obtained sum as the data $q\Delta D$ to the adder 23, where q is a number which changes with time as 1, 2, 3, etc. The output signal Q from the flip-flop 26 is applied to the reset terminal R of the accumulator 24. When the signal Q is in state "1", the accumulator 24 is reset, while when the signal is in state "0", the accumulator is allowed to perform its accumulating operation. The set terminal S of the flip-flop 26 is supplied with the start pulse SP from the one-shot multivibrator 8 (FIG. 1), whereas the reset terminal R is supplied with the end pulse EP from the end address detection circuit 15 (FIG. 1).

In the operation of the clock pulse generator circuit 14 constructed as thus far described, when the sound production command switch 7 (FIG. 1) is closed, the start pulse SP of state "1" is delivered from the one-shot multivibrator 8, setting the flip-flop 26. Since the output signal Q from the fip-flop 26 assumes state "1", the accumulator 24 is reset and so the output data $q\Delta D$ takes on state "0". Accordingly, it follows that the adder 23 supplies the reference frequency division data NVD from the reference dividing factor generator circuit 22 to the variable frequency divider circuit 21 as frequency division data, i.e, without altering the data NVD. Thus, the frequency divider circuit 21 produces clock pulses $\phi 1$ whose frequency is an integer submultiple of that of the master clock pulses $\phi$, the submultiple depending on the division factor indicated by the reference frequency division data NVD. Consequently, when the switch 7 is closed, the variable frequency divider 21 produces the clock pulses $\phi 1$ whose frequency f1 correspond to the reference frequency division data NVD (see FIG. 4 (*a*) and (*b*)). This condition is maintained until the flip-flop 26 is reset by the end pulse EP of state "1" produced from the end address detection circuit 15.

In this way, the data items MD for the rising portion A and for the portion B of the waveform of the musical tone which are stored in the waveshape memory 1 (FIG. 1) are successively read according to the clock pulses $\phi 1$ of the frequency f1. When the first readout of the data MD about the portion B of the waveform is completed, i.e., the address data ADD reaches the end address ENA first, the end address detection circuit 15 produces the end pulse EP of state "1". Thus, the flip-flop 26 is reset, and its output signal Q takes on state 0. This brings the accumulator 24 out of the reset condition and hence the accumulator begins to accumulate the data $\Delta D$ about the modified division factor from this instant. Immediately after the occurrence of the end pulse EP, the output data $q\Delta D$ from the accumulator 24 assumes state "0", and therefore the reference dividing factor data NVD is supplied to the variable frequency divider 21 in the same way as the foregoing case. According to this data NVD, the clock pulses $\phi 1$ of the frequency f1 are produced. Meanwhile, after the end pulse EP is generated, the accumulator 24 performs an accumulating operation on the modified dividing factor data $\Delta D$ each time the clock pulse $\phi 1$ is produced from the frequency divider 21. This data $\Delta D$ assumes a value less than unity, as observed above, and hence the data qΔD consisting of the integral portion of the total count obtained by the accumulator does not immediately reach unity, but rather it is retained in state "0". During this interval, the clock pulses $\phi 1$ of the frequency f1 are produced consecutively from the frequency divider 21. When the total value of the accumulator 24 reaches 1 after production of N clock pulses $\phi 1$, the output data qΔD assumes state "1", and the dividing factor data VD which is given to the frequency divider 21 from the adder 23 takes on the value (NVD +1). Since the frequency of the output clock pulses $\phi 1$ from the frequency divider 21 is equal to the frequency of the master clock pulses $\phi$ divided by the value (NVD +1), the frequency of the clock pulses $\phi 1$ is reduced to $f1-\Delta f$. When N clock pulses $\phi 1$ of the frequency $f1-\Delta f$ are generated, the output data qΔD from the accumulator 24 assumes value 2. Thus, the frequency division data VD provided to the variable frequency divider 21 changes to (NVD +2), thus lowering the frequency of the clock pulses $\phi 1$ from the divider 21 further. In this way, as the frequency division data VD fed to the frequency divider 21 becomes larger gradually, the frequency of the pulses $\phi 1$ from the divider 21 decreases gradually, as shown in FIG. 4 (*a*).

Thus, by supplying the clock pulses $\phi 1$ whose frequency varies as shown in FIG. 4 (*a*) to the address counter 12, the rate at which the data items MD for the portion B of the waveshape of the musical tone are read from the waveshape memory 1 lowers gradually as the frequency of the clock pulses $\phi 1$ is reduced gradually, thereby lowering the pitch of the tone while it is being produced. It is therefore possible to obtain a musical tone whose pitch gradually lowers while the tone is being generated, as encountered in the sounds of percussions such as tom-tom.

Since the reference pitch of a musical tone, or the initial value of the pitch, is determined by the value of the data NVD about the reference dividing factor, it is possible to change the reference pitch by appropriately altering the value of the data NVD. For this purpose, the reference frequency division data generator circuit 22 (FIG. 3) is preferably composed of a ROM for storing a plurality of data items, a potentiometer, and an analog-to-digital converter for converting the output voltage from the potentiometer into digital form, in order to permit the data items NVD of various values to be selectively generated. Further, since the extent to which the pitch of a musical tone lowers can be varied by changing the value of the data ΔD about the modified frequency division, the modified frequency division data generator circuit 25 is preferably so constructed that it can change the value of the data ΔD variously in the same way as the circuit 22. In this case, by changing the value of the data ΔD, the frequency of the clock pulses $\phi 1$ varies as indicated by the broken line, the dash-and-dot line, and the dash-and-two dots line in FIG. 4.

Although the pitch of the musical tone is gradually lowered while it is being produced in the above embodiment, it is also possible to raise the pitch while the sound is being generated. This is attained by increasing the frequency of the clock pulses $\phi 1$ from the clock pulse generator circuit 14 while the tone is being produced. For this purpose, the adder 23 (FIG. 3) may be replaced by a subtracter. Or, the data ΔD about the modified frequency division may be set to a negative value. In this case, the circuitry can be so controlled that the pitch of a musical tone is gradually raised or lowered after the beginning of the production and that the pitch is then gradually lowered or raised.

Also in the above example, the lowering (or change) of the pitch of the musical tone is started just when all the data items MD about the waveshape are once read from the waveshape memory 1, i.e., at the instant when the first end pulse EP is produced. It is to be noted that the instant at which the lowering of the pitch of a sound is started can be set at discretion. For this purpose, another counter may be provided independently of the address counter 12, for example. This additional counter whose number of modulo is greater than that of the counter 12 counts the clock pulses $\phi 1$ after it is cleared by the start pulse SP. The arrival of the total count of the counter at a predetermined value is detected to reset the flip-flop 26 in FIG. 3.

In the above embodiment, only one kind of musical tone is generated. When it is desired to produce a plurality of kinds of musical tones, the same number of the circuits of FIG. 1 are provided, excluding the digital-to-analog converter 5 and the loudspeaker 6. The outputs from the plural multiplier circuit 3 are combined and fed to the common D/A converter 5.

In an alternative arrangement, waveshapes of plural kinds of musical tones to be produced have been previously stored in the waveshape memory 1. The readout control circuit 2 and the envelope generator 4 are operated in time-sharing manner to produce the address data ADD and the envelope data ED about the musical tones in time-sharing manner and to deliver the waveforms to which the envelopes of the musical tones are given from the multiplier circuit 3 in time-sharing manner. The data items delivered from the circuit 3 in time-sharing manner are accumulated, and then the resultant sum is supplied to the D/A converter 5.

It is to be understood that the musical tone generation device in the above-described embodiment is adapted to produce a sound resembling the sound generated by a percussion, and therefore it can be used in an automatic rhythm producing apparatus to produce a rhythmic sound, for example. In this case, musical tones can be automatically produced in accordance with a rhythm pattern by using rhythm pattern pulses delivered from a rhythm pattern generation circuit instead of using the start pulse SP from the one-shot multivibrator 8 shown in FIG. 1.

Obviously, the musical tone generation device according to the present invention can be used to produce musical tones other than the tones generated by percussions. For instance, in case where the sound of a piano is to be produced, the waveform of the sound is previously stored in the waveshape memory 1, and then the stored data about the waveshape is read out in response to information that is created by manipulating the keyboard. In this case, it is possible to provide circuits as shown in FIG. 1 corresponding to the keys of the keyboard for storing the data about the waveforms of the musical tones, which correspond to their respective keys and have different frequencies, in their respective waveshape memories 1. Alternatively, the circuit of FIG. 1 may be used in common to all the keys, and the frequency of the clock pulses $\phi 1$ entering the address counter 12 may be changed so as to correspond to the pitch of a depressed key. This is achieved by using the values corresponding to the pitches of the depressed keys as the reference frequency division data NVD shown in FIG. 3, and appropriately changing the value of the modified frequency division data ΔD according to the pitch of the depressed key. Also, the output signal from the sound production command switch 7 which is applied to the one-shot multivibrator 8 shown in FIG. 1 may be replaced by a signal which is delivered from a keyboard circuit and which assumes state "1" when a key is depressed.

As thus far described, according to the present invention, all the data items are stored in the waveshape memory regarding the rising portion of the waveform of a musical tone. In respect of the portion following the rising portion, the data about only part of it is stored in the memory. After the data items about the rising portion of the waveform is once read from the memory, the data about the aforementioned portion of the waveform is repeatedly read from it to produce the musical tone. Consequently, it is possible to obtain a musical tone which closely resembles the sound generated by an acoustic, non-electronic musical instrument with a limited capacity of waveshape memory. Further, in the present invention, the rate at which the data about said portion of the waveform is repeatedly read is changed while the sound is being produced, whereby the pitch of the produced sound varies during the production. Thus, it is possible to faithfully reproduce sounds of acoustic, non-electronic musical instruments whose pitch changes during production of the sounds, especially the sounds produced by percussions such as a tom-tom, a bongo, or the like.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A musical tone generation device of waveshape memory type for generating a musical tone waveshape which comprises rising portion correspoding to a rise-up of the waveshape and a portion succeeding to the rising portion, said device comprising:

memory means for storing first waveshape data which represent an entire part of the rising portion of a musical tone waveshape and second waveshape data which represent only a part of the portion of the waveshape succeeding to the rising portion;

readout means for reading out said first waveshape data to form the rising portion of a waveshape to be generated and for repetitively reading out said second data to form said succeeding portion of the waveshape to be generated; and rate control means, associated with said readout means, for controlling the rate for reading out said second data from said memory means so as to establish a pitch of the generated tone waveshape at the portion succeeding to the rising portion, which pitch corresponds generally to one musical tone name, and for varying said readout rate with the lapse of time so as to to cause a corresponding variation of said pitch with passage of time.

2. A device accoding to claim 1, in which said rate control means provides a rate which varies to be slow with passage of time.

3. A device according to claim 1, in which said rate control means provides a rate which varies to be fast with passage of time.

4. A device according to claim 1, in which said memory means comprises a plurality of memory locations which are accessible by said readout means, said first and second waveshape data being stored at the respective memory locations selected at a certain order, and said readout means reads out according to said certain order the first waveshape data stored at some of said memory locations and repetitively reads out the second waveshape data in some of said memory locations according to said certain order and according to a rate specified by said control means.

5. A device according to claim 4, in which said readout means comprises:

a presettable address counter for generating address data to access said memory means;

an address detector for detecting that said address counter outputs end address data which correspond to an end address of said second waveshape data stored in said memory means according to said certain order; and a repeat address generator for generating repeat address data which correspond to a start address of said second waveshape according to said certain order, said repeat address being preset in said address counter upon detection of the end address data by said detector so that the readout means repetitively reads out the second waveshape data.

6. A device according to claim 5, in which said control means comprises;

a variable frequency divider for frequency-dividing a pulse signal to generate a clock pulse to drive said address counter; and a data generator for generating dividing factor data which determine a dividing factor of said frequency divider and which vary with passage of time, thereby causing said clock pulse to vary in frequency with passage of time.

* * * * *